US005609129A

United States Patent [19]

Hauf et al.

[11] Patent Number: 5,609,129

[45] Date of Patent: Mar. 11, 1997

[54] CYLINDER HEAD ARRANGEMENT OF AN INTERNAL-COMBUSTION ENGINE

[75] Inventors: Roland Hauf, Leonberg-Hoefingen; Klaus Groeger, Hemmingen, both of Germany

[73] Assignee: Dr. Ing. H.C.F. Porsche AG, Germany

[21] Appl. No.: 490,575

[22] Filed: Jun. 15, 1995

[30] Foreign Application Priority Data

Jun. 16, 1994 [DE] Germany ..... 44 21 057.4

[51] Int. Cl.[6] ..... F02F 1/24; F01L 1/053; F01M 11/02

[52] U.S. Cl. ..... 123/193.5

[58] Field of Search ..... 123/193.5, 90.27, 123/193.1, 193.3

[56] References Cited

U.S. PATENT DOCUMENTS

| | | | |
|---|---|---|---|
| 4,593,657 | 6/1986 | Aoi et al. | 123/193.5 |
| 4,660,529 | 4/1987 | Yoshikawa | 123/90.27 |
| 4,805,563 | 2/1989 | Nishimura et al. . | |
| 4,823,747 | 4/1989 | Wagner et al. | 123/90.27 |
| 4,944,263 | 7/1990 | Nagano et al. . | |
| 5,080,057 | 1/1992 | Batzill et al. | 123/193.5 |
| 5,101,777 | 4/1992 | Onishi et al. | 123/90.27 |
| 5,150,675 | 9/1992 | Murata . | |
| 5,207,197 | 5/1993 | Klingmann et al. | 123/90.27 |
| 5,458,099 | 10/1995 | Koller et al. | 123/193.5 |

FOREIGN PATENT DOCUMENTS

| | | |
|---|---|---|
| 3209901C1 | 10/1983 | Germany . |
| 3641129C1 | 7/1987 | Germany . |
| 4116942C1 | 5/1992 | Germany . |

OTHER PUBLICATIONS

Volvo Service Manual No. TP 317 14/2, Engine Model B6304, 1991, pp. 1, 10–11, 29–31.

*Primary Examiner*—Marguerite McMahon
*Attorney, Agent, or Firm*—Evenson, McKeown, Edwards & Lenahan P.L.L.C.

[57] ABSTRACT

A cylinder head arrangement of an internal-combustion engine has a three-part housing which comprises a basic housing fitted onto a cylinder block, a bucket tappet housing inserted in the basic housing, and a fitted-on cylinder head cover. The bucket tappet housing is constructed in one piece. The guiding and bearing of engine camshafts takes place in divisible bearing brackets whose upper parts are integrated in the cylinder head cover and whose lower parts are constructed in the basic housing. As a result, a construction of the individual elements is obtained which is easy to manufacture and is largely free of undercuts, the individual elements having a high overall stiffness in the mounted condition and being easy to mount.

30 Claims, 6 Drawing Sheets

4
T
T
42
39
28
M
10
31
41
3
12
40
24
13
31
30
32
24
32
17
15
2,8
T2
7
M
7
T1

CYLINDER HEAD ARRANGEMENT OF AN INTERNAL-COMBUSTION ENGINE

BACKGROUND AND SUMMARY OF THE INVENTION

This invention relates to a cylinder head arrangement having a basic housing fitted onto a cylinder block, a bucket tappet housing and a cover on the basic housing.

German Patent Document DE 41 16 942 C1 shows a cylinder head arrangement of the above-mentioned type in which a basic housing is fitted onto the cylinder block and is screwed together with it. The basic housing has pulled-up or drawn-up outer walls onto which a hood-type cover is placed. In the interior space formed by the cylinder head cover and the pulled-up outer walls of the basic housing, a bucket tappet housing is arranged at a distance from the outer walls and is screwed to the basic housing. The bucket tappet housing is constructed in several parts and, in a basic element, has the guides of the valve buckets and the lower bearing bracket halves for the bearing of the camshafts. Separate upper bearing bracket halves are placed on these lower bearing bracket halves and are screwed to the bottom parts.

From Volvo Service Manual No. TP 317 14/2, Page 11, a cylinder head for engine Model B6304 is known in which the basic housing placed on the cylinder block is constructed in one piece with the bucket tappet guide and the bottom parts of camshaft bearings. A cylinder head cover, which carries the upper parts of the bearing, are placed onto this basic housing.

For achieving an optimal material structure which has a high strength particularly on the combustion chamber side, it is desirable that this be achieved by a casting process which is largely free of undercuts, as is possible, for example, by means of the type-forming prior art. However, in this case, the construction of the bucket tappet housing according to the prior art which is screwed to the basic housing requires high mounting expenditures caused by the plurality of screwed connections. Also, there are high manufacturing and repair expenditures because of the bearing of the camshafts in the bucket tappet housing-because, during the manufacturing, these bearings bores require a firm reference between the bucket tappet housing and the basic housing. A firm assignment between the bucket tappet housing and the basic housing is therefore also required during the repair and during the exchange.

It is therefore an object of the invention to improve a cylinder head arrangement of the above-mentioned type in that a high-strength material structure, particularly of the basic housing, can be achieved, in that the whole cylinder head arrangement has a high overall stiffness and is easy to manufacture and to mount.

According to the invention, this object is achieved by a basic housing having charge cycle ducts and valve guides, said basic housing fitting on an engine cylinder block, a bucket tappet housing placed on the basic housing, and a cylinder head cover which covers cam shafts disposed in two part bearing brackets, wherein the bucket tappet housing is arranged in a space formed by the basic housing and the cylinder head cover, wherein the bucket tappet housing is constructed in one piece, wherein lower bearing bracket halves of the two-part bearing brackets are integrated in the basic housing, and wherein upper bearing bracket halves of the two-part bearing brackets are constructed at least partially in the cylinder head cover.

Additional advantageous developments of the invention are described herein.

If, in the case of such a cylinder head arrangement, the bearing of the camshafts takes place between the basic housing and the cylinder head cover and the bucket tappet housing is constructed in one piece and is used only for guiding the valve buckets, structural members are obtained which are easy to manufacture and mount and which have a high overall stiffness in the mounted condition. The assembly of the three individual elements, including the basic housing, the bucket tappet guide housing and the cylinder head cover can in this case take place by means of a small number of screwed connections. At the same time, this arrangement results in a very compact construction of the cylinder head arrangement which has a relatively low height for a cylinder head with overhead camshafts and bucket tappets and mainly as a narrow width. In the case of such a construction of the cylinder head arrangement, the cylinder head cover and the bucket tappet housing may be manufactured, for example, as die-cast components. The basic housing of the cylinder head arrangement can advantageously be produced by permanent-mold casting in which case only the ducts (in the case of a water-cooled cylinder head) which are required for guiding the water must be produced by means of molding sand or similar casting or molding techniques. At the same time, by means of this three-part construction of the cylinder head arrangement, only a single junction plane is obtained which must be sealed off to the outside so that a discharge of oil can be prevented by comparatively simple means.

The overall stiffness of the cylinder head arrangement in the mounted condition can be increased advantageously when the bearing brackets are each connected with adjoining outer walls; that is, when the upper bearing bracket halves are connected with the respective adjoining outer wall of the cylinder head cover and the lower bearing bracket halves are connected with the respective adjoining outer wall of the basic housing.

For producing the cylinder head arrangement, important simplifications are obtained if the connection between the cylinder head cover and the basic housing is situated in a junction plane and this junction planes coincides with the junction plane of the bearing bracket halves.

The mounting of the cylinder head arrangement can be considerably simplified when the screwed connection between the cylinder head cover and the basic housing takes place at least in the area of the cylinder bores by the screwing-together of the bearing bracket halves. This results in a considerable reduction of the screwed connection points. At the same time, the width of the cylinder head arrangement is reduced because in the outer area no more screwed connections are required for the purpose of this joining.

A favorable, high-strength screwed connection is obtained between the cylinder head arrangement and the cylinder block if, for each cylinder, four cylinder screws are provided which are disposed around the cylinder bore in a rectangular arrangement. In this case, it is advantageous if, in the case of a sufficient space between the respective cylinders, as occurs, for example, in the case of horizontally opposed engines, one bearing bracket is in each case arranged between two cylinder screws of the adjoining cylinder bores.

The manufacturing and mounting of the camshaft bearing is considerably simplified if, on a face of the cylinder head arrangement, the bearing of the respective camshaft takes place by means of an individual bearing bracket. By means of these individual bearing brackets, when the camshafts are mounted, the pressing-down may take place against the effect of the valve springs. It is particularly advantageous for the construction and manufacturing of the camshaft bearing if the axial guiding of the camshafts takes place by means of these individual bearing brackets.

The arrangement of the individual bearing brackets advantageously takes place in the area of the chain cases required for the drive of the camshafts. The bores of the camshaft bearing may then be carried out from the opposite face of the cylinder head arrangement so that, during the mounting of the camshafts, these openings in the face may at the same time be used as an engagement device for a tool for pressing down the camshafts.

The connection between the bucket tappet housing and the basic housing advantageously takes place in a junction plane into which ducts for the guiding of oil may be cast in a manner which is advantageous with respect to manufacturing techniques. Thus, the required bore expenditures for the guiding of the oil can be considerably reduced. By way of these cast oil ducts, the lubrication of the valve buckets and of the camshaft can take place by means of a few bores.

The manufacturing as well as the sealing of the cylinder head arrangement can be improved if the shaft which leads into the combustion chamber and is used for receiving a spark plug or an injection device, is lengthened and sealed off by means of a sleeve which is inserted between the bucket tapped housing and the cylinder head arrangement. This sleeve can be inserted in a simple and easily mountable manner into a ring-shaped projection in the bucket tappet housing and can be sealed off.

Other objects, advantages and novel features of the present invention will become apparent from the following detailed description of the invention when considered in conjunction with the accompanying drawings.

DETAILED DESCRIPTION OF THE DRAWINGS

Figure 5:
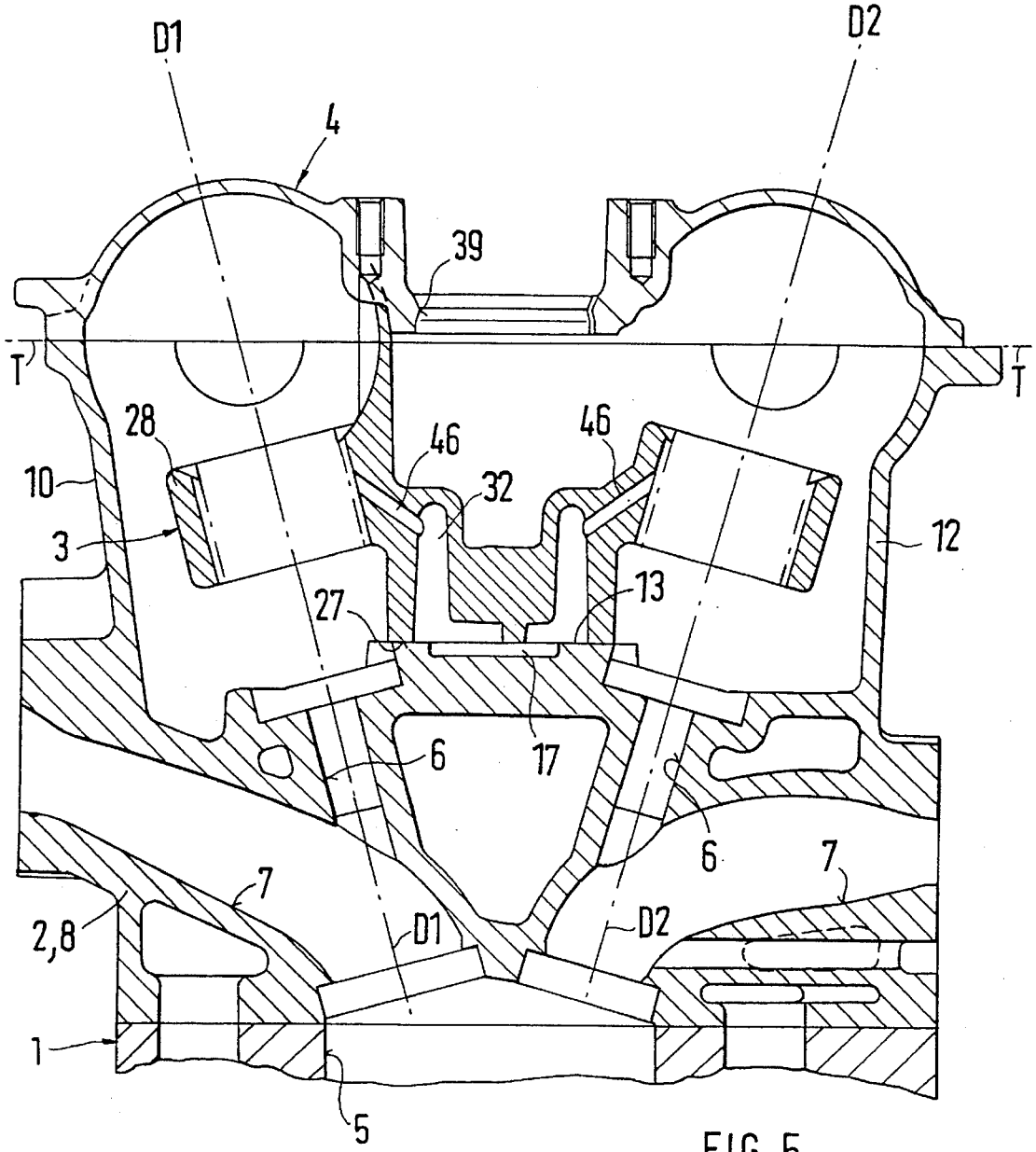
FIG. 5 is another cross-sectional view in the area of the valve guide of a cylinder along Line V—V of FIG. 1.
Figure 6:
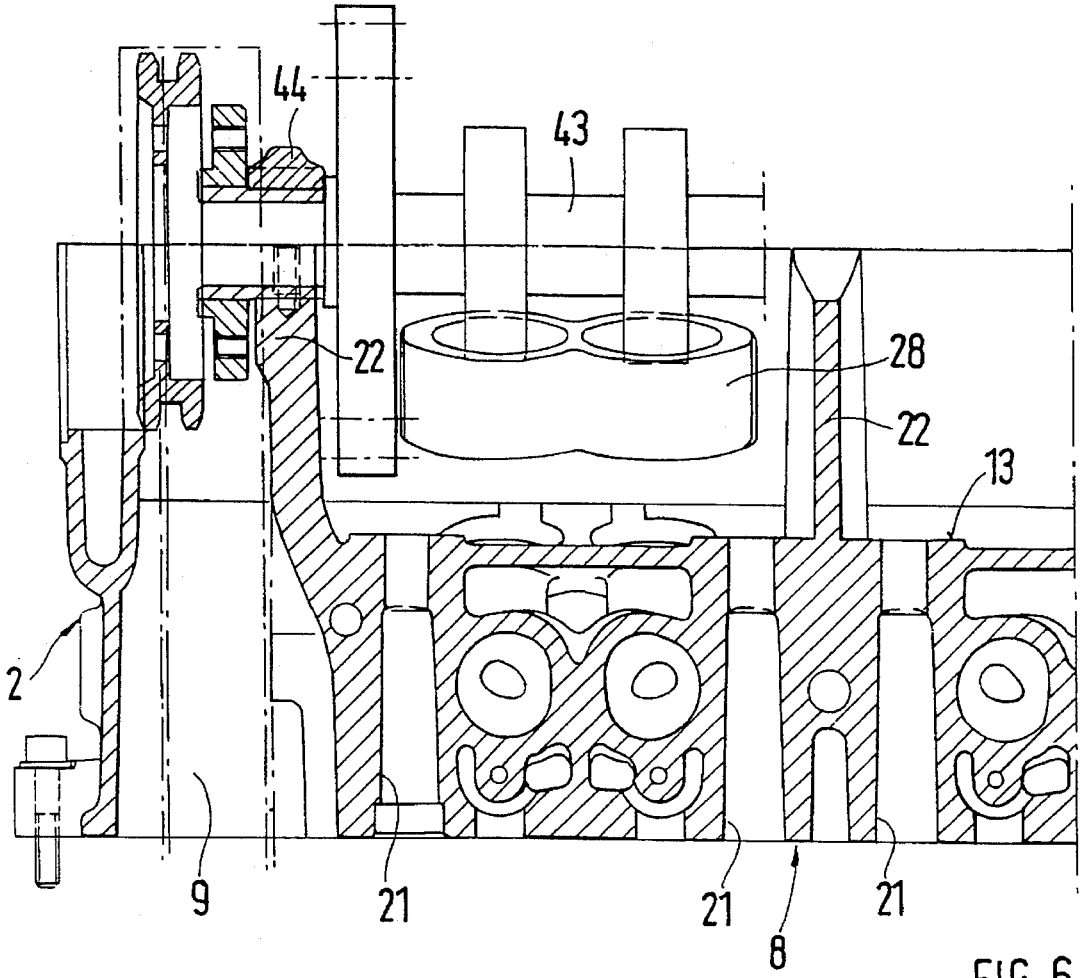
FIG. 6 is a longitudinal sectional view of a portion of the basic housing along Line VI—VI of FIG. 1.

An internal-combustion engine comprises a cylinder head arrangement which is placed on a cylinder block 1 (FIG. 5) and whose housing is composed of three structural housing members, specifically a basic housing 2, a bucket tappet housing 3 and a cylinder head cover 4. In the illustrated embodiment, the internal-combustion engine is represented in the form of a cylinder bank of a six-cylinder horizontally opposed engine with four valves respectively per cylinder and two overhead camshafts. This internal-combustion engine therefore has three cylinder bores 5 per cylinder bank; according to the type of representation selected in FIG. 1, these cylinder bores are indicated to be a left, a central and a right cylinder, or a corresponding cylinder bore 5. Combustion air and exhaust flow to and from each of these cylinder bores 5 is controlled by way of four diaphragm springs (two inlet valves, two outlet valves) which are guided in valve guides 6 and are not shown in detail, and by corresponding charge cycle ducts 7. The charge cycle ducts 7 and valve guides 6 are integrated in a basic block 8 of the basic housing 2 which is adjoined on an end face by a chain case 9. This chain case 9 is used for receiving driving devices for the control drive which are not shown. Outer walls 10, 11 and 12 start out from the basic block 8 of the basic housing 2 and are pulled up opposite an interior supporting surface 13 to a junction plane T—T. The chain case 9 is enclosed by outer walls 14 which also reach to the junction plane T—T and adjoin the walls 10 and 12 of the basic block 8.

In the basic block 8 of the basic housing 2, three shafts 15 are constructed, which each originate from the supporting surface 13 and lead into one of the three cylinder bores 5. The axes of the three shafts 15 are situated in a longitudinal center plane M and are used for receiving one spark plug 16 respectively. Particularly in the case of compression engines, they may also be used for receiving injection devices or heater plugs. Each of these shafts 15 is surrounded by a ring-shaped cast-in indentation 17 which is part of the oil guide of the cylinder head. The ring-shaped indentation 17 in the area of the left cylinder is connected with an also cast-in longitudinal groove 18 which, in a manner not shown in detail, is connected with the oil supply of the cylinder head arrangement. This longitudinal groove 18 extends approximately in parallel to the longitudinal center plane M. The ring-shaped indentations in the area of the central and right cylinder are connected with one another by another cast-in longitudinal groove 19 which is also connected with the oil supply of the cylinder head arrangement and extends approximately in parallel to the longitudinal center plane M. The ring-shaped indentations 17 and the longitudinal grooves 18 and 19 are each surrounded by a sealing web 20 whose sealing surface is part of the supporting surface 13. The ring-shaped indentations 17 are each situated inside a rectangle formed by the passage openings of the valve guides 6 into the base 13, the shorter sides of the rectangle being situated in parallel to the longitudinal center plane M. The valve guides 6 are each inclined with respect to this plane and are arranged in two rows.

The screwed connection of the basic housing 2 with the cylinder block 1 takes place in two rows; that is, the screwed connections are each situated in a plane E1 and E2 in parallel to the longitudinal center plane M. The screwed connections 21 between the basic housing 2 and the cylinder block 1 and the other screwed connections, which will be explained in greater detail in the following, for the purpose of a clearer view, are represented here only by their bores. In this case, four screwed connections 21 respectively are provided for each cylinder bore 5, the connecting lines of the screwed connections 21 forming a rectangle which surrounds the valve guides 6. The shorter sides of the rectangle formed by the four screwed connections 21 per cylinder extend in parallel to the longitudinal center plane M.

Figure 1:
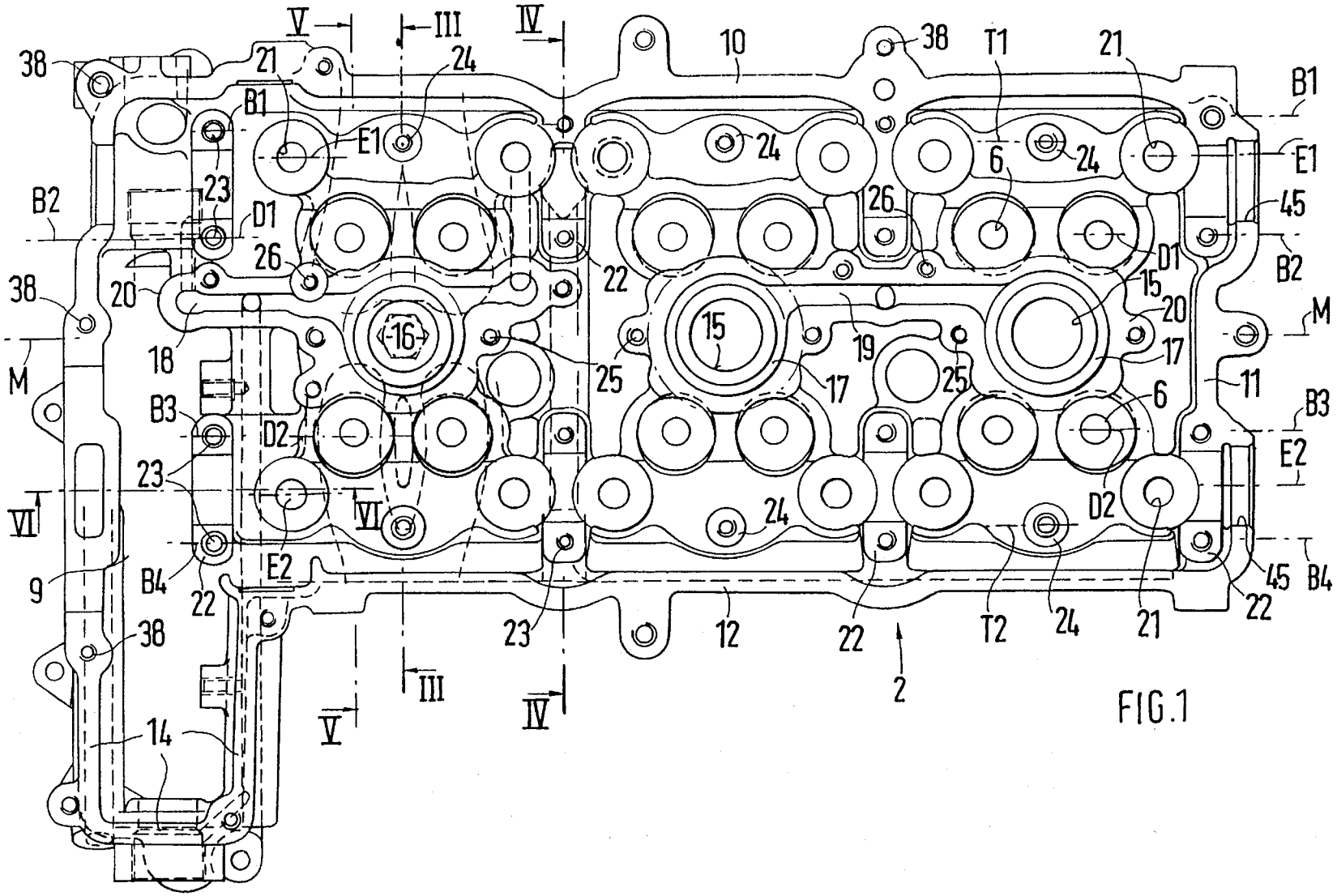
FIG. 1 is a top view of an opened basic housing of the cylinder head arrangement, constructed according to a preferred embodiment of the present invention.
Figure 2:
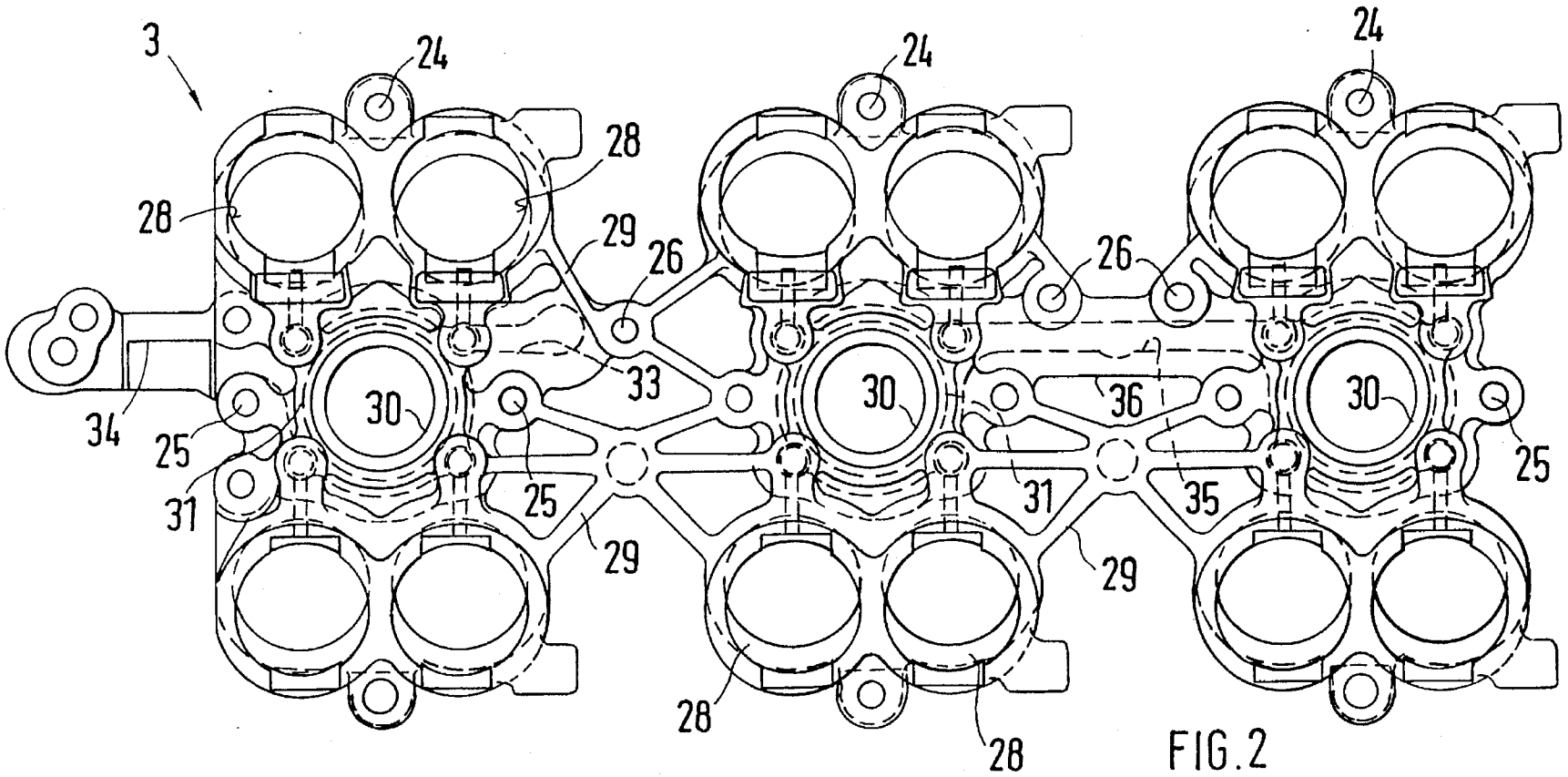
FIG. 2 is a top view of the bucket tappet housing of the cylinder head arrangement constructed according to the preferred embodiment of the present invention.
Figure 3:
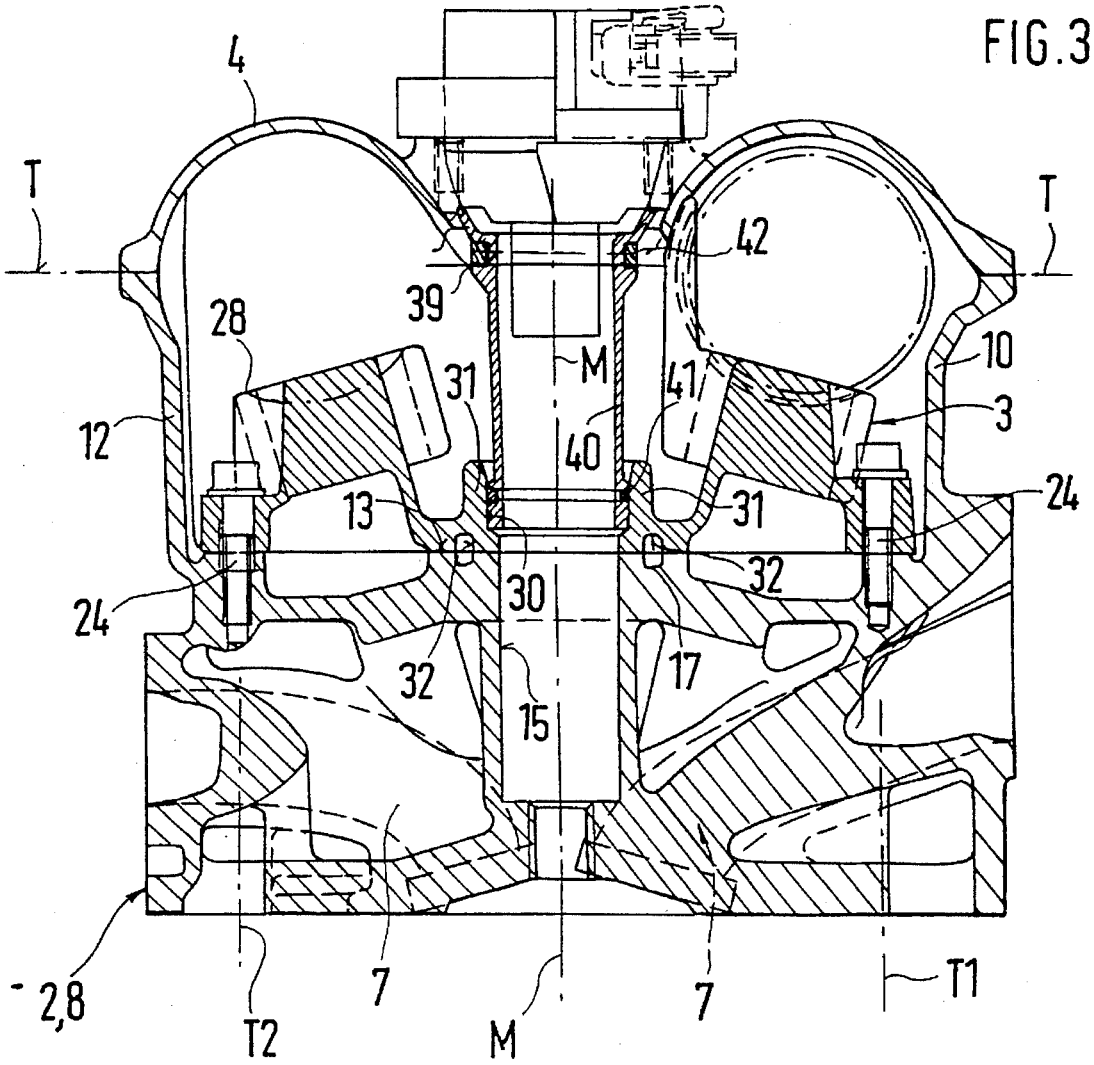
FIG. 3 is a cross-sectional view of the cylinder head arrangement through the combustion chamber center of a cylinder along Line III—III according to FIG. 1.
Figure 4:
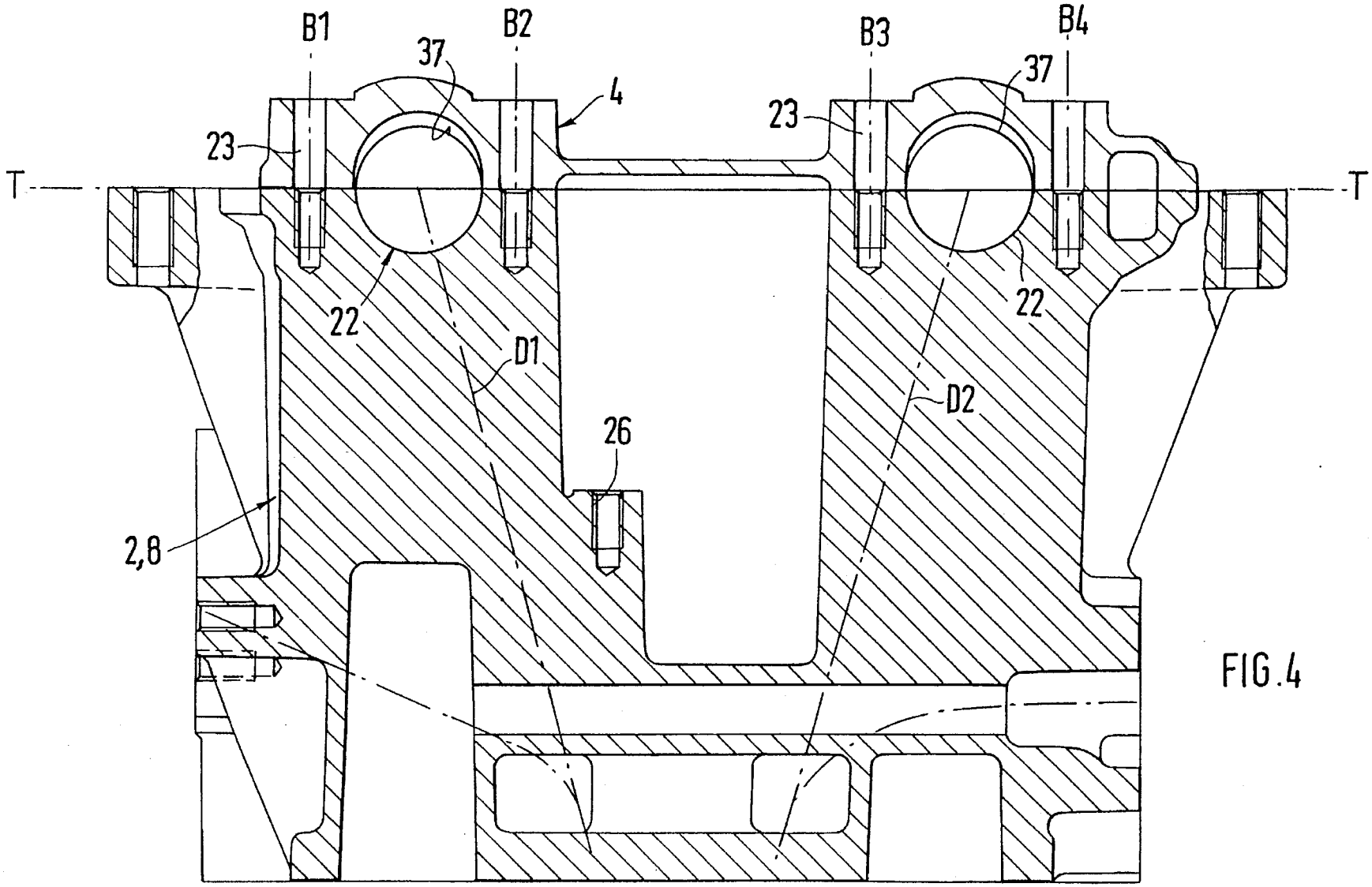
FIG. 4 is another cross-sectional view in the area of a bearing bracket along Line IV—IV of FIG. 1.

Furthermore, in the basic block 8 of the basic housing 2, four lower bearing bracket halves 22 are arranged for each camshaft or each valve row. In this case, the lower bearing bracket halves of the two valve rows are in each case situated opposite one another in pairs. A first pair of bearing bracket halves 22 is arranged in the area of the chain case 9; a second pair of bearing bracket halves 22 is situated in the area of the opposite outer or face wall 11; and two additional pairs of bearing bracket halves 22 are situated between the left cylinder and the central cylinder and between the central cylinder and the right cylinder. In this case, these two pairs of bearing bracket halves 22 are each arranged between two adjoining screwed connections 21 of the adjoining cylinder bores 5. In each of the lower bearing bracket halves 22, two bores 23 are provided for the screwed connection with the upper bearing bracket halves described in detail in the following. These bores 23 are arranged in such a manner that the camshaft to be inserted is situated between them. In this case, four rows or planes of screwed connections and bores 23 are formed which, in the alignment of the basic housing 2 illustrated in FIG. 1, are marked in the downward direction by means of reference symbols B1 to B4. The bore plane B1 is situated above the plane E1 of the screwed connections 21, and the bore plane B2 is situated below this plane. Both bore planes B1 and B2 are situated above the center plane M. The bore planes of the lower row of bearing bracket halves have the reference symbols B3 and B4; bore plane B3 being situated above and bore plane B4 being situated below the plane E2 of the screwed connections 21.

Between the screwed connections 21 for each cylinder bore 5, which are situated in a plane E1 and E2, a respective other screwed connection 24 is situated by means of which the bucket tappet housing 3 and the basic housing 2 are connected with one another. In this case, the screwed connections 24 of the bucket tappet housing 2 are situated in two planes T1 and T2 in parallel to the center plane M. The upper plane T1 is situated between the bore plane B1 facing the outer wall 10 and the plane E1 of the screwed connections 21; the lower plane T2 is situated between the lower plane E2 of the screwed connections 21 and the bore plane B4 of the bearing bracket halves 22 which faces the outer wall 12. A third row of screwed connections 25 for the bucket tappet housing 3 is situated in the longitudinal center plane M. For a better sealing of the cast oil ducts, additional screwed connections 26 are provided in the area of the sealing webs 20.

The bucket tappet housing 3 is placed by means of its base 27 onto the supporting surface 13 of the basic housing 2 in such a manner that the bores and screwed connections 24 to 26 continue in a corresponding fashion. The bucket tappet housing 3 comprises four bucket tappet guides 28 per cylinder bore 5 which are aligned with the respective axes of the valve guides. The four bucket tappet guides 28 per cylinder are connected with one another. Each of these groups of four bucket tappet guides 28 is connected by way of webs 29 with the adjacent group of bucket tappet guides 28 so that the whole bucket tappet housing is constructed in one piece. Inside the space bounded by the four bucket tappet guides per cylinder bore, a bore 30 is provided which is aligned with the shaft 15. On the top side of the bucket tappet housing 2, each of these bores is surrounded by a ring-shaped lengthening 31. In the base 27 of the bucket tappet housing 3, a ring groove 32 is constructed for each bore 30 which surrounds this bore 30 and which, together with the ring-shaped indentation 17 in the supporting surface 13, forms an oil duct. The ring groove 32 in the area of the left cylinder bore is connected with a longitudinal groove 33 which is arranged in a longitudinal web 34 and forms an oil duct with the longitudinal groove 18 in the basic housing 2. The ring grooves 32 in the area of the central and right cylinder bore are also connected with one another by means of a longitudinal groove 35 which interacts with the corresponding longitudinal groove 19 in the basic housing 2 and is cast into a longitudinal web 36. The oil supply of the bucket tappet guides takes place by way of diagonal bores 46 which lead into the ring groove 32.

The cylinder head arrangement is closed off by a cylinder head cover 4 which., in the area of the junction plane T-T, is placed on the outer walls 10 to 12 and 14 of the basic housing 2 and covers the bucket tappet housing 3. The cylinder head cover contains three pairs of upper bearing bracket halves 37 which each interacts with the lower bearing bracket halves 22 arranged between the left cylinder and the central cylinder, the central cylinder and the right cylinder and in the area of the right face or outer wall 11. These upper bearing bracket halves 37 each start out from an outer wall of the cylinder head cover 4 and are connected with it in one piece. The screwed connection between the basic housing 2 and the cylinder head cover 4 takes place in the area of the basic block 8 by means of the screwed connection 23 of the bearing bracket halves. Only in the area of the chain case 9, additional screwed connections 38 are provided in the area of the outer walls 14. In the cylinder head cover 4, three bores 39 are arranged which are each aligned with one of the shafts 15. Sleeves 40 are inserted into these bores 39 and project into the ring-shaped lengthening 31 of the bucket tappet housing 3 and are sealed off there and in the area of the bores 39 by means of sealing rings 41 and 42 respectively. These sleeves 40 extend and seal off the shaft 15 or the bore 30 with respect to the interior which is formed by the basic housing 2 and the cylinder head cover 4.

In the area of the chain case 9, the bearing of the camshafts 43 takes place by means of the two lower bearing bracket halves 22 onto which separate individual upper bearing bracket parts 44 are placed. These separate upper bearing bracket parts 44 are wider (viewed in the axial direction) than the corresponding lower bearing bracket half 22 and take over the axial guiding of the camshaft. As a result, only one separate upper bearing part per camshaft must be machined for the axial guiding. During the mounting, the separate upper bearing bracket parts simultaneously cause on the chain case side the pressing-down of the camshafts against the effect of the valve springs which are not shown. On the opposite face 11 of the basic housing or in the corresponding face of the cylinder head cover, mounting bores 45 are entered which, on the one hand, are used for machining the bearing bores and, on the other hand, are used for the pressing-down of the camshafts during the mounting and provide the free space required for this purpose.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder head arrangement for an internal combustion engine with a cylinder block, said cylinder head arrangement comprising:

a basic housing having charge cycle ducts and valve guides, said basic housing fitting on an engine cylinder block, a bucket tappet housing placed on the basic housing, and a cylinder head cover which covers cam shafts disposed in two part bearing brackets, wherein the bucket tappet housing is arranged in a space formed by the basic housing and the cylinder head cover, wherein the bucket tappet housing is constructed in one piece, wherein lower bearing bracket halves of the two-part bearing brackets are integral with the basic housing, and wherein upper bearing bracket halves of the two-part bearing brackets are constructed at least partially in the cylinder head cover.

2. Cylinder head arrangement according to claim 1, wherein the upper bearing bracket halves are integral piece with an outer wall of the cylinder head cover, and wherein the lower bearing bracket halves are integral with an outer wall of the basic housing.

3. Cylinder head arrangement according to claim 1, wherein the connection surface between the basic housing and the cylinder head cover is situated in a junction plane with the junction surface of the bearing bracket halves.

4. Cylinder head arrangement according to claim 1, wherein the basic housing is connected to the cylinder head cover by means of a screwed connection of the bearing bracket halves.

5. Cylinder head arrangement according to claim 1, wherein a screwed connection between the basic housing and the cylinder block takes place by four cylinder screws per cylinder which, in each case, surround an associated cylinder bore in a rectangular arrangement.

6. Cylinder head arrangement according to claim 5, wherein at least one bearing bracket is arranged between the rectangular arrangements of each set of adjacent cylinder bores.

7. Cylinder head arrangement according to claim 1, wherein a chain case is arranged on a face of the cylinder head arrangement, the camshafts being disposed in the area of the chain case by means of one individual bearing bracket, respectively.

8. Cylinder head arrangement according to claim 7, wherein a bottom side of the individual bearing bracket is formed by a lower bearing bracket half which is integrated in the basic housing and onto which a separate upper bearing bracket part is placed.

9. Cylinder head arrangement according to claim 7, wherein the axial bearing of the camshaft takes place by means of the individual bearing bracket.

10. Cylinder head arrangement according to claim 7, wherein a bore in alignment with the camshaft is constructed on the face of the cylinder bore arrangement which is situated opposite the chain case.

11. Cylinder head arrangement according to claim 3, wherein cast-in oil ducts extend in the junction plane between the basic housing and the bucket tappet housing.

12. Cylinder head arrangement according to claim 11, wherein lubricating oil supply to the bucket tappet guides takes place by way of the cast-in oil ducts.

13. Cylinder head arrangement according to claim 11, wherein the lubricating oil supply of the camshaft takes place by way of the cast-in oil ducts in the junction plane and by way of drilled oil ducts to a bearing bracket.

14. Cylinder head arrangement according to one of claim 1, wherein the valve guides and bucket tappet guides surround a shaft leading into a respective cylinder bore, and wherein this shaft is lengthened and sealed off by means of a sleeve which is inserted between the bucket tappet housing and the cylinder head cover.

15. Cylinder head arrangement according to claim 14, wherein the bucket tappet housing has a ring-shaped lengthening which surrounds the shaft and into which the sleeve is fitted and is held and sealed by means of a sealing ring.

16. Cylinder head arrangement according to claim 2, wherein the connection surface between the basic housing and the cylinder head cover is situated in a junction plane with the junction surface of the bearing bracket halves.

17. Cylinder head arrangement according to claim 16, wherein the basic housing is connected to the cylinder head cover by means of a screwed connection of the bearing bracket halves.

18. Cylinder head arrangement according to claim 17, wherein a screwed connection between the basic housing and the cylinder block takes place by four cylinder screws per cylinder which, in each case, surround an associated cylinder bore in a rectangular arrangement.

19. Cylinder head arrangement according to claim 18, wherein at least one bearing bracket is arranged between the rectangular arrangements of each set of adjacent cylinder bores.

20. Cylinder head arrangement according to claim 2, wherein a chain case is arranged on a face of the cylinder head arrangement, the camshafts being disposed in the area of the chain case by means of one individual bearing bracket respectively.

21. Cylinder head arrangement according to claim 19, wherein a chain case is arranged on a face of the cylinder head arrangement, the camshafts being disposed in the area of the chain case by means of one individual bearing bracket respectively.

22. Cylinder head arrangement according to claim 20, wherein a bottom side of the individual bearing bracket is formed by a lower bearing bracket half which is integrated in the basic housing and onto which a separate upper bearing bracket part is placed.

23. Cylinder head arrangement according to claim 21, wherein a bottom side of the individual bearing bracket is formed by a lower bearing bracket half which is integrated in the basic housing and onto which a separate upper bearing bracket part is placed.

24. Cylinder head arrangement according to claim 23, wherein the axial bearing of the camshaft takes place by means of the individual bearing bracket.

25. Cylinder head arrangement according to claim 24, wherein a bore in alignment with the camshaft is constructed on the face of the cylinder bore arrangement which is situated opposite the chain case.

26. Cylinder head arrangement according to claim 25, wherein cast-in oil ducts extend in the junction plane between the basic housing and the bucket tappet housing.

27. Cylinder head arrangement according to claim 26, wherein lubricating oil supply to the bucket tappet guides takes place by way of the cast-in oil ducts.

28. Cylinder head arrangement according to claim 26, wherein lubricating oil supply of the camshaft takes place by way of the cast-in oil ducts in the junction plane and by way of drilled oil ducts to a bearing bracket.

29. Cylinder head arrangement according to claim 18, wherein valve guides and bucket tappet guides surround a shaft leading into a respective cylinder bore, and wherein this shaft is lengthened and sealed off by means of a sleeve which is inserted between the bucket tappet housing and the cylinder head cover.

30. Cylinder head arrangement according to claim 29, wherein the bucket tappet housing has a ring-shaped lengthening which surrounds the shaft and into which the sleeve is fitted and is held and sealed by means of a sealing ring.

* * * * *